US011109468B1

(12) United States Patent
Qiu et al.

(10) Patent No.: US 11,109,468 B1
(45) Date of Patent: Aug. 31, 2021

(54) LIGHTING APPARATUS WITH REDUCED ABRUPT BRIGHTNESS CHANGES

(71) Applicant: Lumileds LLC, San Jose, CA (US)

(72) Inventors: Yifeng Qiu, San Jose, CA (US); Alan Andrew McReynolds, Los Altos, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/077,614

(22) Filed: Oct. 22, 2020

(51) Int. Cl.
*H05B 45/20* (2020.01)
*H05B 45/325* (2020.01)
*H05B 47/17* (2020.01)

(52) U.S. Cl.
CPC ..... *H05B 47/17* (2020.01); *H05B 45/20* (2020.01); *H05B 45/325* (2020.01)

(58) Field of Classification Search
CPC ..... H05B 45/10; H05B 45/20; H05B 45/30; H05B 45/325; H05B 45/46; H05B 45/395; H05B 45/3577; H05B 47/10; H05B 47/17
See application file for complete search history.

(56) References Cited

U.S. PATENT DOCUMENTS

| | | | | |
|---|---|---|---|---|
| 7,088,059 | B2 * | 8/2006 | McKinney | H05B 45/37 315/291 |
| 10,517,156 | B1 * | 12/2019 | Qiu | H05B 45/20 |
| 2009/0302779 | A1 * | 12/2009 | McKinney | H05B 45/37 315/294 |
| 2010/0164399 | A1 * | 7/2010 | Radermacher | H05B 45/20 315/294 |
| 2019/0313503 | A1 * | 10/2019 | Woytowitz | H05B 47/19 |
| 2020/0413514 | A1 * | 12/2020 | Qiu | H05B 45/20 |

* cited by examiner

*Primary Examiner* — Thai Pham
(74) *Attorney, Agent, or Firm* — Schwegman Lundberg & Woessnr, P.A.

(57) ABSTRACT

A light-emitting apparatus can reduce flicker and retain power efficiency. A method can include driving, by a light emitting element (LEE) driver circuit, first, second, and third LEEs using a pulse width modulation (PWM) driving scheme to generate light of a first color, the first, second, and third LEEs configured to emit different colors, alternating, by the LEE driver circuit, between driving the first, second, and third LEEs using a hybrid driving scheme and the PWM driving scheme, and after alternating between driving the first, second, and third LEEs in the hybrid and PWM driving schemes, driving, by the LEE driver circuit, the first, second, and third LEEs using the hybrid driving scheme.

20 Claims, 6 Drawing Sheets

LIGHTING APPARATUS WITH REDUCED ABRUPT BRIGHTNESS CHANGES

TECHNICAL FIELD

The present disclosure relates to a light-emitting apparatus and a light-emitting apparatus control system configured to reduce or eliminate a visible flash experienced in switching between lighting driving schemes. Embodiments can dither (switch) between driving schemes (lighting modes) to reduce the delta in load experienced when switching lighting driving schemes, such as to reduce the visible flash experienced in switching between the driving schemes.

BACKGROUND

In some applications, such as home or commercial lighting, user experience is very important. Further, color tuning is an integral part of human-centric lighting. Some control technologies offer lighting specifiers that allow end-users new possibilities in lighting control. In addition to correlated color temperature (CCT) tuning over a wide range, the user can change the tint of the white, or other color, light along a CCT line as they desire.

BRIEF DESCRIPTION OF THE DRAWINGS

The figures show various views of an apparatus, system, or method, including a control system that can alter light emerging from one or more light emitting elements (LEES), in accordance with some embodiments. The terms "front," "rear," "top," "side," and other directional terms are used merely for convenience in describing the apparatuses and systems and other elements and should not be construed as limiting in any way.

Figure 1:
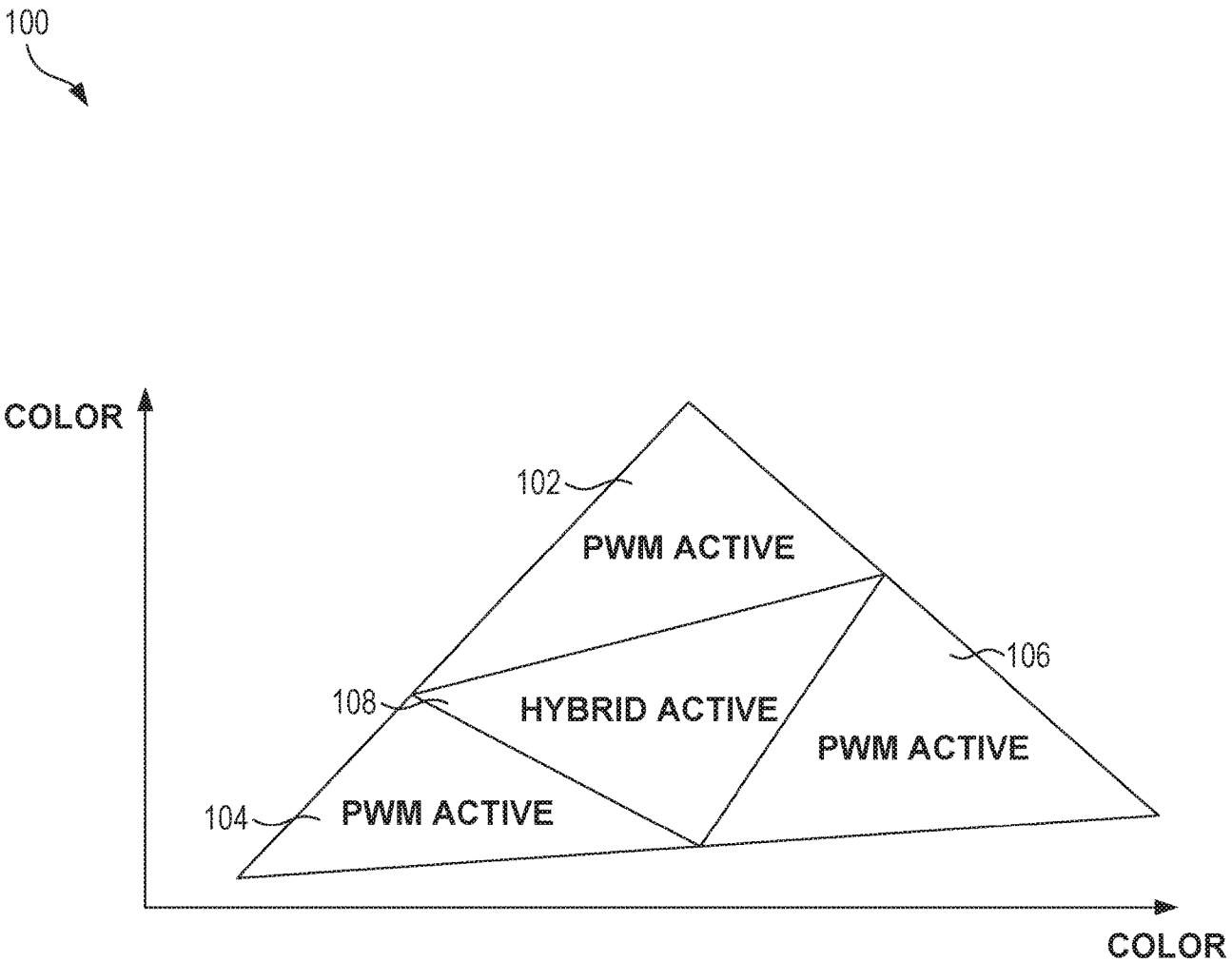
FIG. 1 illustrates, by way of example, a diagram of an embodiment of a color space divided into hybrid and pulse width modulation (PWM) driving scheme regions.

Corresponding reference characters indicate corresponding parts throughout the several views. Elements in the drawings are not necessarily drawn to scale. The configurations shown in the drawings are merely examples and should not be construed as limiting the scope of the disclosed subject matter in any manner.

DETAILED DESCRIPTION

The home and commercial lighting systems, with their wide tuning range on a single platform, are ideal candidates for all kinds of color-tunable applications. Previously, a hybrid LEE driving scheme, which drives LEEs of two colors at the same time, was disclosed in U.S. Pat. No. 10,517,156. The hybrid driving scheme provides a higher electrical power efficiency than a 3-channel sequential pulse width modulation (PWM) driving scheme. This comes at the cost of reduced color options (see FIG. 1).

To provide increased color options, a controller can be configured to cause a driver circuit to drive LEEs using the hybrid driving scheme for colors that can be realized using the hybrid driving scheme and the PWM driving scheme for colors outside the hybrid driving scheme. However, in switching between driving the LEEs in the PWM driving scheme and the hybrid driving scheme, a visible flash is realized. The flash confuses a user and is perceived as a defect. Embodiments provide a system, apparatus, and method to mitigate the visually perceptible flash that is caused by crossing the boundary from the PWM driving scheme to the hybrid driving scheme during color tuning or color changing.

FIG. 1 illustrates, by way of example, a diagram of an embodiment of a color space divided into hybrid 108 and PWM 102, 104, 106 driving scheme regions. In the embodiment of FIG. 1, the color points are realized by a controller driving LEEs using either a hybrid 108 driving scheme or a PWM 102, 104, 106, driving scheme. Since the hybrid 108 driving scheme is more energy efficient, if the color point can be generated using the hybrid 108 driving scheme, then improved energy efficiency can be realized by driving the color point using the hybrid driving scheme. The hybrid 108 driving scheme, however, cannot be used to produce some colors that can be produced using the PWM 102, 104, 106 driving scheme.

A flash of light can be seen when the controller switches to/from operating LEEs using a hybrid 108 driving scheme from/to a PWM 102, 104, 106 driving scheme. This change in driving scheme can be due to a change in the color produced by the lighting apparatus that includes the LEEs. One color can be driven by the hybrid 108 driving scheme, while a next or previous color may not be able to be able to be produced using the hybrid 108 driving scheme. Thus, the next or previous color is produced by driving the LEEs using the PWM 102, 104, 106 driving scheme. The flash of light can be interpreted, by a human, to indicate that something went wrong with the lighting system. This causes unnecessary concern for the user and can reduce user confidence in the product. Embodiments provide ways to mitigate the flash of light and user concern, while still allowing efficient operation of the LEEs using the hybrid 108 driving scheme (for those colors that are capable of being produced using the hybrid 108 driving scheme).

As discussed, in implementation, the hybrid driving scheme can be used when the desired color point is within the range of colors that can be produced using the hybrid 108 driving scheme. The sequential PWM driving scheme can be used for all colors, including those of the hybrid driving scheme. However, for energy efficiency purposes, the PWM driving scheme can be limited to (only) instances when the color to be produced is not capable of being produced using the hybrid driving scheme.

Figure 3:
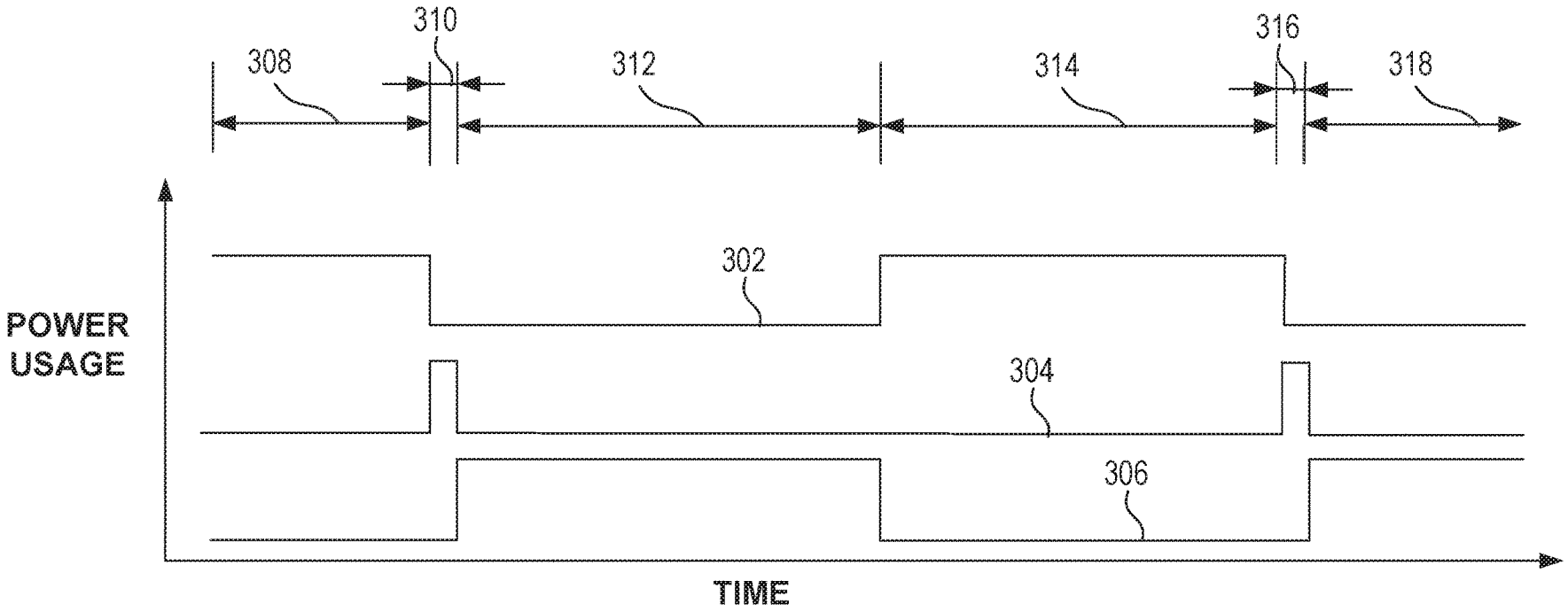
FIG. 3 illustrates, by way of example, a diagram of an embodiment of a graph of power vs time for three LEE different colors of a PWM driving scheme.

In the PWM driving scheme, each LEE color is switched on in sequence (see FIG. 3 for an illustration and further discussion). Using the PWM driving scheme, each LEE color is driven with the same magnitude current. The visible color is controlled by changing the PWM duty cycle of each LEE color. That is, one LEE color can be driven longer than another LEE color to change the mixed color. As human vision is unable to perceive changes in color faster than 80 Hertz (Hz), the light appears to have one single color.

For example, a first LEE color can be driven with a current for a certain amount of time, then the second LEE color can be driven with the same current for a certain time, and then the third LEE color can be driven with the current for a certain amount of time. The perceived color, as previously discussed, can be controlled by changing the duty cycle of each color. For example, if there are red, green, and blue LEEs and a specific color is desired, the red LEE can be driven for a portion of the cycle, the green LEE can be driven for a different portion of the cycle, and the blue LEE can be driven for yet another portion of the cycle to realize the color. Using PWM, instead of driving the red LEE at a lower current, it is driven at the same current for a shorter time. This example demonstrates the downside of PWM with the LEEs poorly utilized leading to inefficiencies.

Using a hybrid driving scheme, the combined benefits of analog and PWM driving schemes are provided. The hybrid driving scheme divides the input current between two LEE colors while treating the set of two colors as a virtual LEE to overlay PWM time slicing.

The hybrid driving scheme achieves the similar level of overall efficacy as an analog driving scheme using the same number of LEEs while preserving color predictability. In comparison to a hybrid driving scheme, the PWM driving scheme can require 50% more LEEs to achieve the same efficacy. The benefits of the hybrid driving scheme include reduced utilization of the LEEs, decreased current consumption, increased LEE efficacy and overall efficacy, and the provision of the included PWM drivers benefit in the color point predictability and the controller complexity.

Operationally, the hybrid driving scheme is described in U.S. Pat. No. 10,517,156 and utilizes an analog current division circuit to drive two colors of the LEE array simultaneously and then overlays PWM time slicing with the third color of the LEE array. In driving the two colors simultaneously, virtual color points are created. Using the three colors of the LEE array, three virtual color points can be created (R-G, R-B, G-B) plus an optional primary color R/G/B (fourth color point for mixing). The triangle formed by the three virtual color points (R-G, R-B, G-B) defines the gamut of the new driving scheme.

Figure 2:
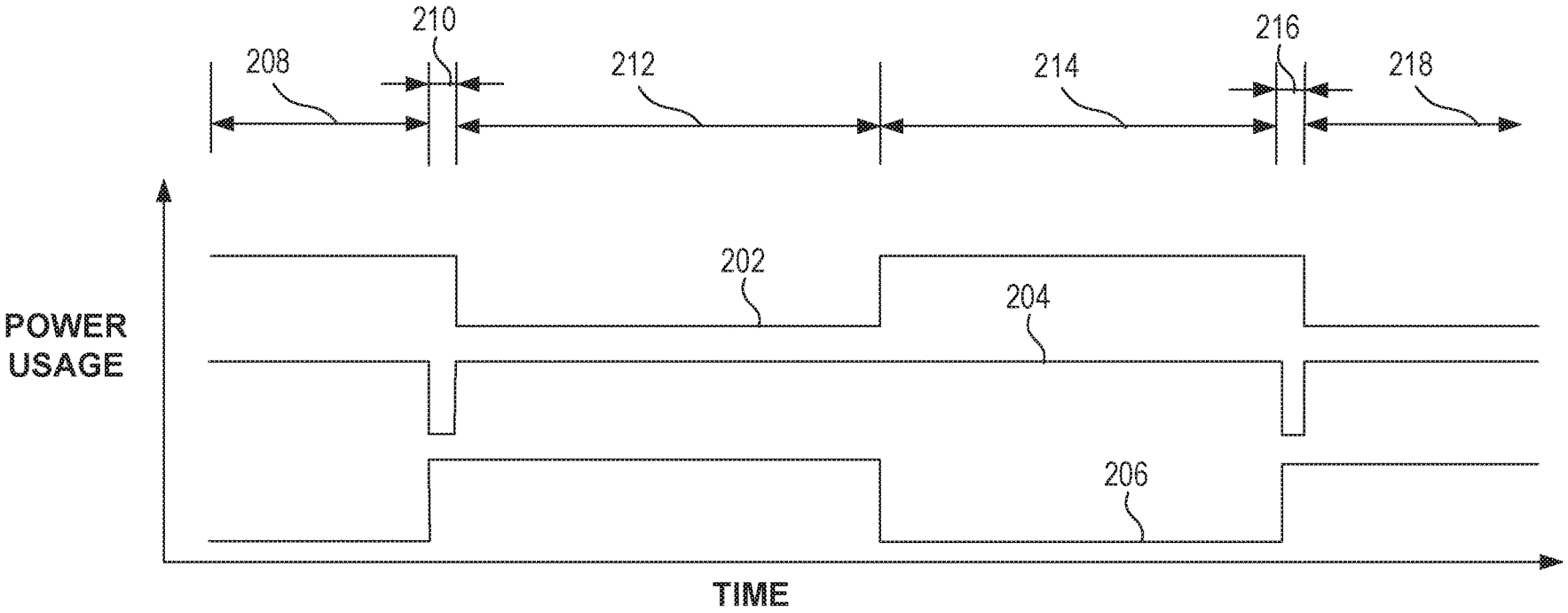
FIG. 2 illustrates, by way of example, a diagram of an embodiment of a graph of power vs time for three light emitting elements (LEES) of colors of a hybrid driving scheme.

The following description summarizes the timing sequence of the operation of the hybrid driving scheme for 3-channel LED driving (see FIG. 2 and the corresponding description thereof for more details). The specific sequence of virtual colors is merely an example. In implementations of the hybrid driving scheme, the color duplets may be arranged or rearranged in a way to minimize the complexity of the overlaying PWM logic implementation. During a first sub-interval T1, the color duplet of Red-Green may be powered. During a second, immediately subsequent sub-interval T2, the color duplet of Green-Blue may be powered. During the next immediately subsequent sub-interval T3, the color duplet of Red-Blue may be powered. The sum of sub-intervals T1, T2 and T3 combine to substantially cover a switching period T.

By using the hybrid driving scheme unless the color cannot be produced using the hybrid driving scheme, else using the PWM driving scheme, the controller may have to cross the boundary between the colors provided by the hybrid driving scheme and PWM driving scheme when performing color tuning. There are twice as many LEEs being driven in parallel in the hybrid driving scheme as compared to the PWM driving scheme. This means the impedance of the LEE load changes when the controller causes the driver to drive the LEEs in the hybrid driving scheme and then in the PWM driving scheme, or vice versa. The impedance change causes a step response at the driver output. The step response causes the instantaneous output current amplitude to increase or decrease. The duration and the magnitude of the step response depends on the driver as well as its dim level. In practice, the step response change is visible as a momentary change in intensity, or a visual flash or blackout.

At, or around the time of, the transition from the PWM driving scheme to the hybrid driving scheme, the driver output current can rise up sharply and then slowly roll off. This current spike causes the instantaneous light output to increase dramatically and appear as a visible light burst. At, or around the time of, the transition from the hybrid driving scheme to the PWM driving scheme, the driver output current drops sharply and the slowly rolls up. This current drop can appear as a visible brief blackout.

Embodiments can help mitigate the flash or blackout (sometimes called chromatic flicker) experienced in changing between PWM and hybrid driving schemes. Embodiments can implement a dithering procedure (rapid switching between driving schemes) in circuitry, software, firmware, or the like. The dithering procedure can be executed when the color tuning changes between hybrid and PWM driving schemes, or other driving schemes. The dithering process entails switching back and forth between the hybrid and PWM driving schemes. As the driving scheme change is initiated by color point change, the process could potentially cause chromatic flicker. In order to avoid chromatic flicker, the whole process can be carried out in multiple operations. This takes advantage of the fact that the area where the PWM driving scheme can be active includes the area where the hybrid driving scheme is active. For a transition from the PWM driving scheme to the hybrid driving scheme, the operations can include, in order:

1. Change to the new color point while staying in PWM mode.
2. Change from the PWM driving scheme to the hybrid driving scheme.
3. Switch back and forth between driving schemes.

Dithering sequence of different patterns and lengths can be employed. A sequence alternating between the source driving scheme (S) (either PWM driving scheme or the hybrid driving scheme) and the target driving scheme (T) (either the hybrid driving scheme or the PWM driving scheme) (e.g., as TSTS . . . TST) and ending on the target driving scheme is effective.

The duration of the step response depends on both the driver and the LED load. The length of the dithering sequence can be adaptive. This can be achieved by hard-coding the sequence per design, by conducting a self-calibration during operation, or by monitoring the change in instantaneous current.

FIG. 2 illustrates, by way of example, a diagram of an embodiment of a graph of power vs time for three LEEs of different colors of a hybrid driving scheme. Line 202 represents power of a first color, line 204 represents power of a second color, and line 206 represents power of a third color. The colors can be different and chosen from red, green, or blue, for example. In operating the hybrid driving scheme, two of the colors (only two of the colors) are driven at a given time. For example, the LEEs that produce the first and second colors are driven during time periods 208 and 214 (while the third color is not driven during the same time periods 208 and 214); the LEEs that produce the first and third colors are driven during time periods 210 and 216

(while the second color is not driven during the same time periods 210 and 216); and the LEEs that produce the second and third colors are driven during time periods 212 and 218 (while the first color is not driven during the same time periods 212 and 218). The duration of the time periods 208, 210, 212, 214, 216, 218 is adjustable and such adjustments alter a perceived color, brightness, tint, or the like produced by the LEEs, FIG. 3 illustrates, by way of example, a diagram of an embodiment of a graph of power vs time for three LEEs of different colors of a PWM driving scheme. Line 302 represents power of a first color, line 304 represents power of a second color, and line 306 represents power of a third color. The colors can be different and chosen from red, green, or blue, for example. In operating the PWM driving scheme, one of the colors (only one of the colors) are driven at a given time. For example, the LEE that produces the first color is driven during time periods 308 and 314 (while the second and third colors are not driven during the same time periods 308 and 314); the LEE that produces the second color is driven during time periods 310 and 316 (while the first and third colors are not driven during the same time periods 310 and 316); and the LEE that produces the third color is driven during time periods 312 and 318 (while the first and second colors are not driven during the same time periods 312 and 318). The duration of the time periods 308, 310, 312, 314, 316, 318 is adjustable and such adjustments alter a perceived color, brightness, tint, or the like produced by the LEEs.

Figure 4:
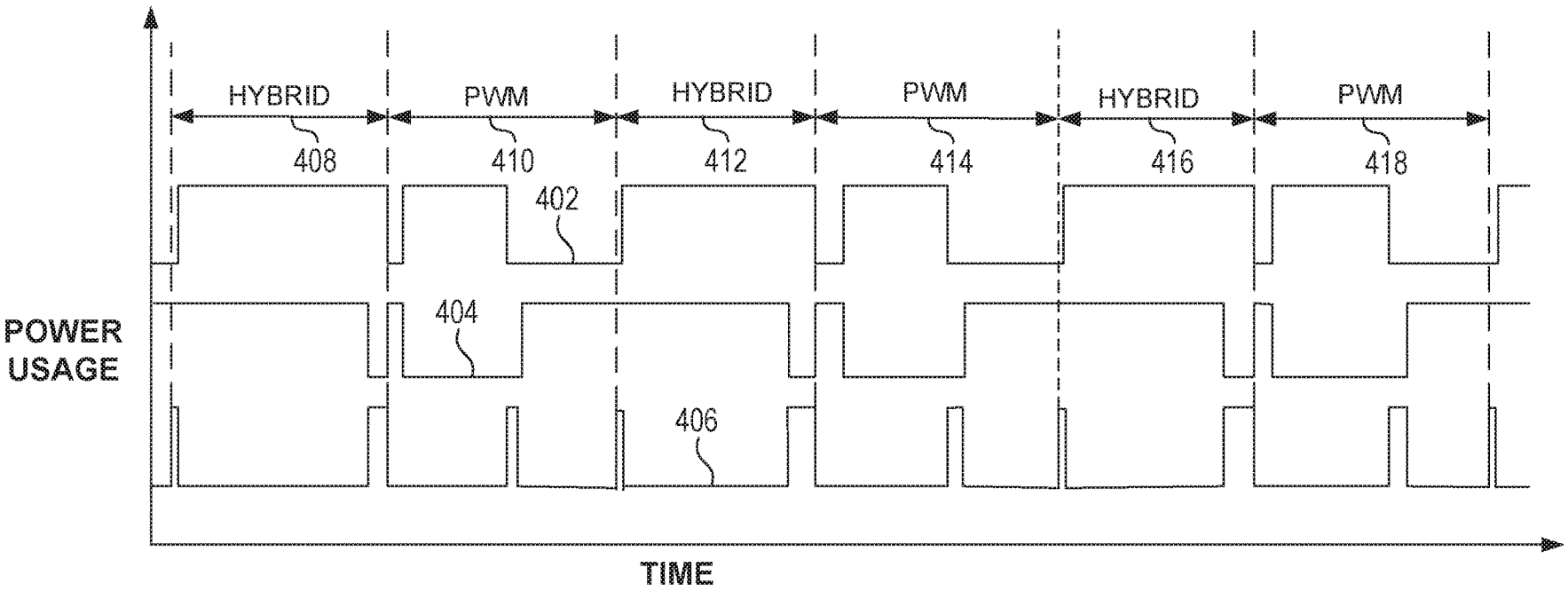
FIG. 4 illustrates, by way of example, a diagram of an embodiment of a graph of power vs time for switching between driving LEEs using PWM and hybrid driving schemes.

FIG. 4 illustrates, by way of example, a diagram of an embodiment of a graph of power vs time for switching between driving LEEs using a PWM driving scheme and a hybrid driving scheme. Line 402 represents power of a first color, line 404 represents power of a second color, and line 406 represents power of a third color. The colors can be different and chosen from red, green, or blue, for example. In operating the PWM driving scheme and as previously discussed, one of the colors (only one of the colors) are driven at a given time. In operating the hybrid driving scheme and as previously discussed, two of the colors (exactly two of the colors) are driven at a given time. For example, the LEEs are driven with a hybrid driving scheme, at time period 408, a PWM driving scheme at a time period 410 immediately subsequent to the time period 408, a hybrid driving scheme at a time period 412 immediately subsequent to the time period 410, and so on through the time periods 414, 416, 418. The duration of the time periods can be less than 1/80 second so that the change between the PWM and the hybrid driving schemes is not perceptible to the human eye. The color produced in the PWM and hybrid driving schemes can be a same color point. This generally requires driving LEEs with different duty cycles for different driving schemes to achieve the same color point.

Figure 5:
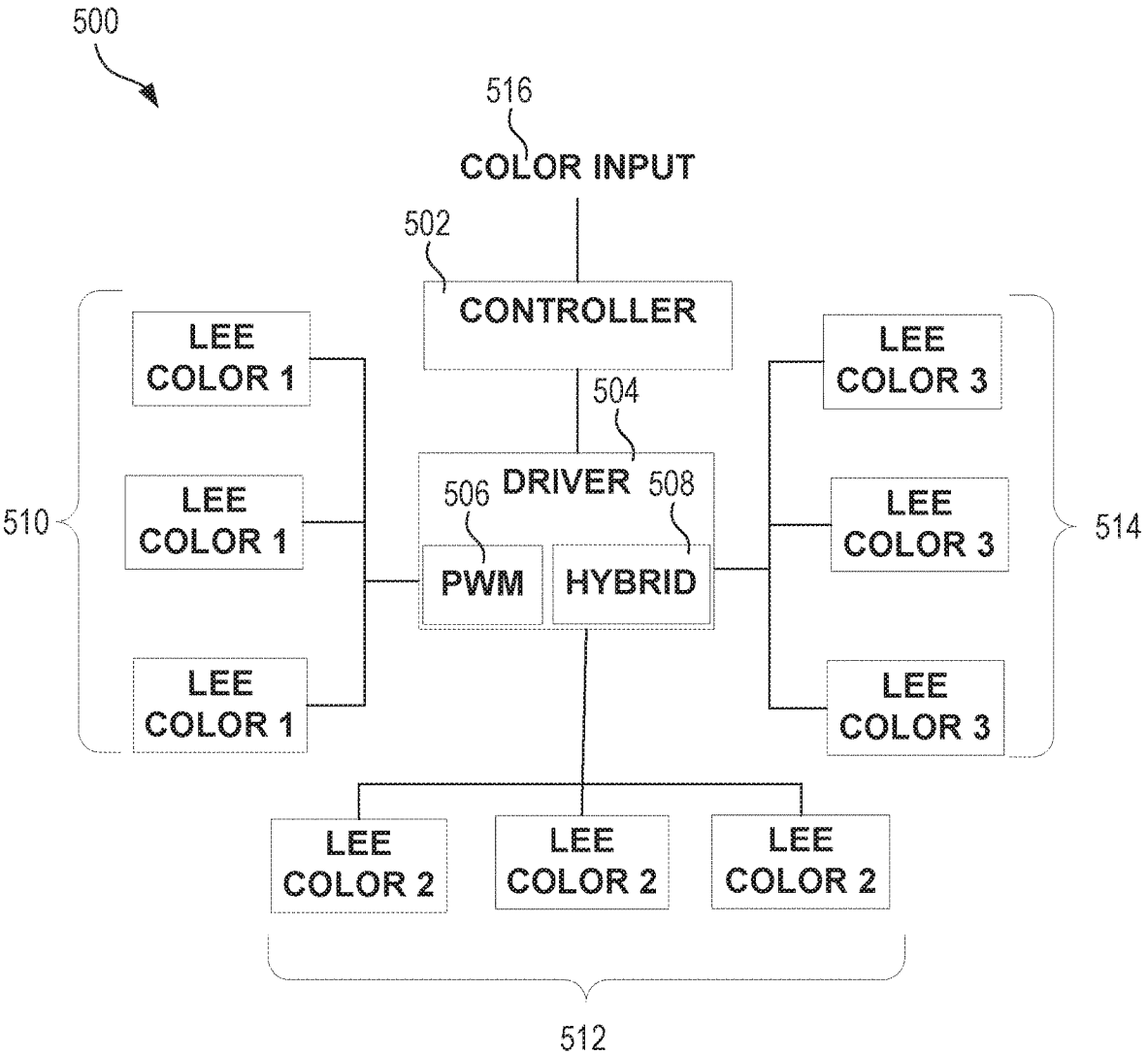
FIG. 5 illustrates, by way of example, a diagram of an embodiment of a system for operating LEEs in different driving schemes, such as to reduce flicker while also operating in hybrid mode wherever possible.

FIG. 5 illustrates, by way of example, a diagram of an embodiment of a system 500 for operating LEEs 510, 512, 514 using different driving schemes, such as to reduce flicker while also reducing electrical power consumption. The system 500 as illustrated includes a controller 502, a driver 504, and the LEEs 510, 512, 514, Each of the LEEs 510, 512, 514 can be of a different color, such as red, green, or blue. The controller 502 can send commands (in the form of electrical signals) that cause the driver 504 to drive the LEEs 510, 512, 514 using a hybrid driving scheme 508 or a PWM driving scheme 506. The controller 502 can include electric or electronic components configured to implement operations of managing the driver 504.

The electric or electronic components can include one or more transistors, resistors, capacitors, diodes, inductors, oscillators, switches, logic gates (e.g., AND, OR, XOR, negate, buffer, or the like), multiplexers, analog to digital converters, digital to analog converters, amplifiers, rectifiers, modulators, demodulators, processors (e.g., central processing units (CPUs), graphics processing units (GPUs), application specific integrated circuits (ASICs), field programmable gate arrays (FPGAs), or the like), memory devices (e.g., random access memory (RAM), read only memory (ROM), or the like), or the like.

The controller 502 can alter the driving scheme implemented by the driver 504 based on color input 516. The color input 516 can be controlled by a user of the system 500. The user can change the brightness, color, tint, hue, or the like of a color and this can be reflected by the color input 516. The controller 502 can determine whether the color indicated by the color input 516 can be provided using the hybrid driving scheme 508. The controller 502 can determine whether a change in driving scheme is required to provide the color indicated by the color input 516. If the color does require a change in driving scheme, the controller 502 can provide commands, through time, that cause the driver 504 to rapidly switch (faster than 1/80 second per driving scheme) between driving schemes. This can be performed responsive to determining that a driving scheme is warranted in providing the color indicated by the color input 516.

The driver 504 can include electrical or electronic components configured to implement power provision to the LEEs 510, 512, 514. The electric or electronic components can include one or more transistors, resistors, capacitors, diodes, inductors, oscillators, switches, logic gates, multiplexers, analog to digital converters, digital to analog converters, amplifiers, rectifiers, modulators, demodulators, processors, memory devices, or the like The LEEs 510, 512, 514 can include light emitting diodes (LEDs), organic LEDs (OLEDs), lasers, or other light emitting devices.

Figure 6:
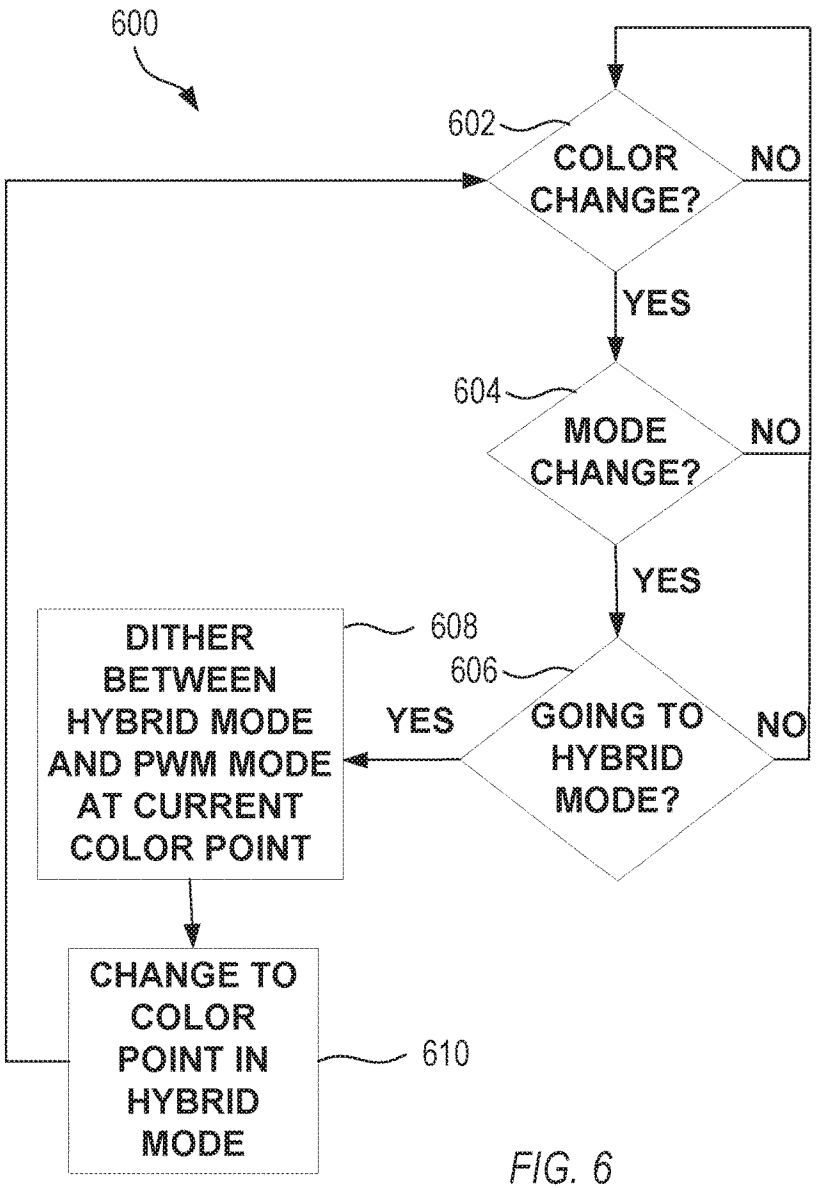
FIG. 6 illustrates, by way of example, a diagram of an embodiment of a method for managing flicker and power consumption in a light emitting apparatus.

FIG. 6 illustrates, by way of example, a diagram of an embodiment of a method 600 for managing flicker and power consumption in a light emitting apparatus. The method 600 can be performed by the controller 502, driver 504, LEEs 510, 512, 514, or a combination thereof. The method 600, as illustrated, includes detecting whether a color point has changed, at operation 602. If the color indicated by the color input 516 changes, then the controller 502 can determine that the color point has changed. If the color point has changed (as determined by operation 602), it can be determined, at operation 604, whether a driving scheme is different for the new color point as compared to the old color point. If the color point has not changed (as determined by operation 602), the operation 602 can be performed again.

The operation 604 can include determining, by the controller 502, a current driving scheme being implemented by the driver 504 and whether the new color point can be realized using the hybrid driving scheme. If the current driving scheme is the hybrid driving scheme and the new color point can be realized using the hybrid driving scheme, then the controller 502 determines, at operation 604, that the scheme has not changed and the method 600 continues at operation 602. If the current driving scheme is the PWM driving scheme and the new color point cannot be realized using the hybrid driving scheme, then the controller 502 determines, at operation 604, that the scheme has not changed and the method 600 continues at operation 602. If the current driving scheme is the hybrid driving scheme and the new color point cannot be realized using the hybrid driving scheme, then the controller 502 determines, at operation 604, that the scheme has changed and the method 600 continues at operation 606. If the current driving scheme is the MAIM driving scheme and the new color point can be realized using the hybrid driving scheme, then the controller 502 determines, at operation 604, that the scheme has changed and the method 600 continues at operation 606.

At operation 606, the controller 502 can determine whether the new color point is to be provided using the hybrid driving scheme. The controller 502 can determine that the color point will be provided using the hybrid driving scheme if the color point can be provided using the hybrid driving scheme. The controller 502 can determine the color point will be provided using the PWM driving scheme if the color point cannot be provided using the hybrid driving scheme. If the controller 502 determines, at operation 606, that the color point will be provided using the PWM driving scheme then the method 600 can continue at operation 602. If the controller 502 determines, at operation 606, that the color point will be provided using the hybrid driving scheme then the method 600 can continue at operation 608.

At operation 608, the controller 502 can issue one or more commands to the driver 504 that cause the driver to dither (switch rapidly) between the hybrid driving scheme and the PWM driving scheme at the current color point. The one or more commands can indicate color pairs and duty cycles required to provide the current color point using the hybrid driving scheme and duty cycles and respective colors required to provide the current color point using the PWM driving scheme. Then, at operation 610, the controller 502 can issue one or more commands to the driver 504 that cause the driver 504 to switch to providing a color point indicated by the color input 516 using the hybrid driving scheme. The command from the controller 502 can include data to the driver 504 indicating colors and respective duty cycles needed to achieve the color indicated by the color input 516.

To further illustrate the apparatus and related method disclosed herein, a non-limiting list of examples is provided below. Each of the following non-limiting examples can stand on its own or can be combined in any permutation or combination with any one or more of the other examples.

In Example 1, a method can include driving, by a light emitting element (LEE) driver circuit, first, second, and third LEEs using a pulse width modulation (PWM) driving scheme to generate light of a first color, the first, second, and third LEEs configured to emit different colors, alternating, by the LEE driver circuit, between driving the first, second, and third LEEs using a hybrid driving scheme and the PWM driving scheme, and after alternating between driving the first, second, and third LEEs in the hybrid and PWM driving schemes, driving, by the LEE driver circuit, the first, second, and third LEEs using the hybrid driving scheme.

In Example 2, Example 1 can further include, wherein the PWM driving scheme includes driving, in sequence, the first LEE, the second LEE, and the third LEE, and the hybrid driving scheme includes driving, in sequence, a first pair of the first, second, and third LEEs simultaneously and a second, different pair of the first, second, and third LEEs simultaneously.

In Example 3, at least one of Examples 1-2 can further include, wherein alternating between driving the first, second, and third LEEs using the hybrid driving scheme and the PWM driving scheme occurs responsive to determining a color provided by a device including the driver circuit and the first, second, and third. LEEs has changed to a second color.

In Example 4, Example 3 can further include, before alternating between driving the first, second, and third LEEs using the hybrid driving scheme and the PWM driving scheme, altering a duty cycle of the first, second, and third LEEs to produce the second color using the PWM driving scheme.

In Example 5, Example 4 can further include, wherein the second color is in a range of colors provided by the hybrid driving scheme and the first color is outside the range of colors provided by the hybrid driving scheme.

In Example 6, Example 5 can further include, wherein the first, second, and third LEEs provide light of one of red, green, and blue color.

In Example 7, Example 6 can further include, wherein the first, second, and third LEEs include light emitting diodes (LEDs).

Example 8 includes a device comprising driver circuitry operable to drive light emitting elements (LEEs) in a pulse width modulation (PWM) driving scheme and a hybrid driving scheme, the LEEs including three or more LEEs that emit respective different colors of light, and controller circuitry configured to cause the driver circuitry to operate the LEEs in the PWM driving scheme to generate light of a first color, then alternate driving the LEEs in the hybrid driving scheme and the PWM driving scheme, and then drive the LEEs in the hybrid driving scheme.

In Example 9, Example 8 can further include, wherein the PWM driving scheme includes driving, in sequence, first, second, and third LEEs of the LEEs, and the hybrid driving scheme includes driving, in sequence, a first pair of the first, second, and third LEEs simultaneously and a second, different pair of the first, second, and third LEEs simultaneously.

In Example 10, at least one of Examples 8-9 can further include, wherein controller circuitry is further configured to receive data indicating a color provided by the device has changed to a second color, and wherein causing the driver circuitry to alternate between driving the LEEs using the hybrid driving scheme and the PWM driving scheme, and wherein occurs responsive to the controller circuitry receiving the data.

In Example 11, Example 10 can further include, before causing the driver circuitry to alternate between driving the first, second, and third LEEs using the hybrid driving scheme and the PWM driving scheme, the controller circuitry is further configured to cause the driver circuitry to alter a duty cycle of the first, second, and third. LEEs to produce the second color using the PWM driving scheme.

In Example 12, Example 11 can further include, wherein the second color is in a range of colors provided by the hybrid driving scheme and the first color is outside the range of colors provided by the hybrid driving scheme.

In Example 13, Example 12 can further include, wherein the first, second, and third LEEs provide light of one of red, green, and blue color.

In Example 14, Example 13 can further include, wherein the first, second, and third LEEs include light emitting diodes (LEDs).

Example 15 can include a system comprising light emitting elements (LEEs) that emit respective different colors of light, driver circuitry operable to drive the LEEs using a pulse width modulation (PWM) driving scheme and a hybrid driving scheme, the LEEs including three or more LEEs that emit respective different colors of light, and controller circuitry configured to cause the driver circuitry to operate the LEEs using the PWM driving scheme to generate light of a first color, then alternate driving the LEEs in the hybrid driving scheme and the PWM driving scheme, and then drive the LEEs in the hybrid driving scheme.

In Example 16, Example 15 can further include, wherein the PWM driving scheme includes driving, in sequence, first, second, and third LEEs of the LEEs, and the hybrid driving scheme includes driving, in sequence, a first pair of the first, second, and third LEEs simultaneously and a second, different pair of the first, second, and third LEEs simultaneously.

In Example 17, at least one of Examples 15-16 can further include, wherein controller circuitry is further configured to receive data indicating a color provided by the device has changed to a second color, and wherein causing the driver circuitry to alternate between driving the LEEs using the hybrid driving scheme and the PWM driving scheme, and wherein occurs responsive to the controller circuitry receiving the data.

In Example 18, Example 17 can further include, before causing the driver circuitry to alternate between driving the first, second, and third LEEs using the hybrid driving scheme and the PWM driving scheme, the controller circuitry is further configured to cause the driver circuitry to alter a duty cycle of the first, second, and third. LEEs to produce the second color using the PWM driving scheme.

In Example 19, Example 18 can further include, wherein the second color is in a range of colors provided by the hybrid driving scheme and the first color is outside the range of colors provided by the hybrid driving scheme.

In Example 20, at least one of Examples 15-19 can further include, wherein the first, second, and third LEEs provide light of one of red, green, and blue color.

While example embodiments of the present disclosed subject matter have been shown and described herein, it will be obvious to those skilled in the art that such embodiments are provided by way of example only. Numerous variations, changes, and substitutions will now occur to those skilled in the art, upon reading and understanding the material provided herein, without departing from the disclosed subject matter. It should be understood that various alternatives to the embodiments of the disclosed subject matter described herein may be employed in practicing the various embodiments of the subject matter. It is intended that the following claims define the scope of the disclosed subject matter and that methods and structures within the scope of these claims and their equivalents be covered thereby.

What is claimed is:

1. A method comprising:

driving, by a light emitting element (LEE) driver circuit, first, second, and third LEEs using a pulse width modulation (PWM) driving scheme to generate light of a first color, wherein the first, second, and third LEEs are configured to emit respective different colors;

alternating, by control circuitry, a driving scheme implemented by the LEE driver circuit, between driving the first, second, and third LEEs using a hybrid driving scheme and the PWM driving scheme; and after alternating between driving the first, second, and third LEEs in the hybrid or PWM driving schemes, driving, by the LEE driver circuit, the first, second, and third LEEs using the hybrid driving scheme.

2. The method of claim 1, wherein:

the PWM driving scheme includes driving, in sequence, the first LEE, the second LEE, and the third LEE; and the hybrid driving scheme includes driving, in sequence, a first pair of the first, second, and third LEEs simultaneously and a second, different pair of the first, second, and third LEEs simultaneously.

3. The method of claim 1, wherein alternating between driving the first, second, and third LEEs using the hybrid driving scheme and the PWM driving scheme occurs responsive to determining a color provided by a device including the driver circuit and the first, second, and third LEEs has changed to a second color.

4. The method of claim 3, further comprising, before alternating between driving the first, second, and third LEEs using the hybrid driving scheme and the PWM driving scheme, altering a duty cycle of the first, second, and third LEEs to produce the second color using the PWM driving scheme.

5. The method of claim 4, wherein the second color is in a range of colors provided by the hybrid driving scheme and the first color is outside the range of colors provided by the hybrid driving scheme.

6. The method of claim 5, wherein the first, second, and third LEEs provide light of one of red, green, and blue color.

7. The method of claim 6, wherein the first, second, and third LEEs include light emitting diodes (LEDs).

8. A device comprising:

driver circuitry operable to drive light emitting elements (LEEs) in a pulse width modulation (PWM) driving scheme and a hybrid driving scheme, wherein the LEEs include three or more LEEs that emit respective different colors of light; and controller circuitry configured to send electrical signals to the driver circuitry that cause the driver circuitry to operate the LEEs in the PWM driving scheme to generate light of a first color, then alternate a driving scheme implemented by the driver circuitry to driving the LEEs in the hybrid driving scheme or the PWM driving scheme, and then drive the LEEs in the hybrid driving scheme.

9. The device of claim 8, wherein:

the PWM driving scheme includes driving, in sequence, first, second, and third LEEs of the LEEs; and the hybrid driving scheme includes driving, in sequence, a first pair of the first, second, and third LEEs simultaneously and a second, different pair of the first, second, and third LEEs simultaneously.

10. The device of claim 8, wherein controller circuitry is further configured to receive data indicating a color provided by the device has changed to a second color, and wherein causing the driver circuitry to alternate between driving the LEEs using the hybrid driving scheme and the PWM driving scheme, and wherein occurs responsive to the controller circuitry receiving the data.

11. The device of claim 10, further comprising, before causing the driver circuitry to alternate between driving the first, second, and third LEEs using the hybrid driving scheme and the PWM driving scheme, the controller circuitry is further configured to cause the driver circuitry to alter a duty cycle of the first, second, and third LEEs to produce the second color using the PWM driving scheme.

12. The device of claim 11, wherein the second color is in a range of colors provided by the hybrid driving scheme and the first color is outside the range of colors provided by the hybrid driving scheme.

13. The device of claim 12, wherein the first, second, and third LEEs provide light of one of red, green, and blue color.

14. The device of claim 13, wherein the first, second, and third LEEs include light emitting diodes (LEDs).

15. A system comprising:

a plurality of light emitting elements (LEEs) configured to emit respective different colors of light;

driver circuitry operable to drive the LEEs using a pulse width modulation (PWM) driving scheme or a hybrid driving scheme, the LEEs including three or more LEEs that emit respective different colors of light; and controller circuitry configured to provide electrical signals that cause the driver circuitry to operate the LEEs using the PWM driving scheme to generate light of a first color, then alternate driving the LEEs in the hybrid driving scheme or the PWM driving scheme, and then drive the LEEs in the hybrid driving scheme.

16. The system of claim 15, wherein:

the PWM driving scheme includes driving, in sequence, first, second, and third LEEs of the LEEs; and the hybrid driving scheme includes driving, in sequence, a first pair of the first, second, and third LEEs simultaneously and a second, different pair of the first, second, and third LEEs simultaneously.

17. The system of claim 15, wherein controller circuitry is further configured to receive data indicating a color provided by the device has changed to a second color, and wherein causing the driver circuitry to alternate between driving the LEEs using the hybrid driving scheme and the PWM driving scheme, and wherein occurs responsive to the controller circuitry receiving the data.

18. The system of claim 17, further comprising, before causing the driver circuitry to alternate between driving the first, second, and third LEEs using the hybrid driving scheme and the PWM driving scheme, the controller circuitry is further configured to cause the driver circuitry to alter a duty cycle of the first, second, and third LEEs to produce the second color using the PWM driving scheme.

19. The system of claim 18, wherein the second color is in a range of colors provided by the hybrid driving scheme and the first color is outside the range of colors provided by the hybrid driving scheme.

20. The system of claim 19, wherein the first, second, and third LEEs provide light of one of red, green, and blue color.

* * * * *